United States Patent [19]

von Blanquet

[11] Patent Number: 4,766,880

[45] Date of Patent: Aug. 30, 1988

[54] APPARATUS FOR DRAWING OFF VAPORS FROM KITCHEN EQUIPMENT

[75] Inventor: Georg von Blanquet, Baden-Baden, Fed. Rep. of Germany

[73] Assignee: Gaggenau-Werke Haus-and Lufttechnik GmbH, Gaggenau, Fed. Rep. of Germany

[21] Appl. No.: 4,879

[22] Filed: Jan. 20, 1987

[30] Foreign Application Priority Data

Jan. 20, 1986 [DE] Fed. Rep. of Germany ..... 3601460

[51] Int. Cl.[4] ..... F24C 15/20

[52] U.S. Cl. ..... 126/299 D

[58] Field of Search ..... 98/115.1, 116, 119; 126/299 R, 299 D

[56] References Cited

U.S. PATENT DOCUMENTS 3,585,920 6/1971 Johnson ..... 126/299 D
3,756,217 9/1973 Field ..... 98/115.1
3,834,295 9/1974 Seidel ..... 126/299 D
4,446,849 5/1984 McFarland ..... 126/299 R
4,501,260 2/1985 Grace ..... 126/299 R

FOREIGN PATENT DOCUMENTS 1579679 7/1974 Fed. Rep. of Germany .

*Primary Examiner*—Larry I. Schwartz
*Attorney, Agent, or Firm*—Antonelli, Terry & Wands

[57] ABSTRACT

An apparatus for drawing off vapor from kitchen equipment comprises at least one draught flue running along one side of the kitchen appliance having a long, narrow exhausting opening and a fan connected thereto by flexible air ducts. To avoid the introduction of cold air on linking with the external atmosphere and also to prevent particles, small kitchen tools or the like dropping into the draught flue when the fan and therefore the kitchen appliance is not in use, on the draught flue is mounted at least one cover for the suction opening in such a way that it pivots between an open and a closed position and is provided with a drive coupled to the fan on-off switch.

9 Claims, 3 Drawing Sheets

APPARATUS FOR DRAWING OFF VAPORS FROM KITCHEN EQUIPMENT

BACKGROUND OF THE INVENTION

The present invention relates to an apparatus for drawing off or exhausting vapors kitchen equipment including at least one exhaust shaft running along one side of the kitchen appliance having a long, narrow suction or exhaust opening and a fan connected thereto by flexible air ducts.

It is known to draw off vapors which occur in connection with kitchen equipment, e.g. cookers, baking ovens, grills, deep fat fryers, etc. by exhaust or suction equipment. Such equipment mainly consists of holds, which are placed above the working surface at a distance such that working on the actual kitchen appliance is not impeded. Additionally, in, for example, DE-AS 1 579 679 ventilating means are proposed which have long, narrow draught flues directly alongside the working surface of the kitchen appliance, so that the vapors can be drawn in a downward direction. The fan can be positioned below the actual apparatus in a cabinet support or even at a greater distance therefrom. Such means have the advantage that the space above the kitchen appliance remains free and the vapor are drawn off closer to the point where they are formed, so that more effective purification of the air is obtained.

Generally a draught flue with a long and narrow exhaust opening is arranged on either side of the kitchen appliance. The exhaust opening is covered by a grating, so that it serves as a storage surface and, in the case of an adequately large free draw-off cross-section, avoids larger objects being able to drop into the draught flue. The latter also contains a sieve or filter for retaining particles, droplets contained in the vapor and the like.

A disadvantage of the above-described construction resides in the fact that if the outgoing air duct of the fan leads outside the building, when not in operation cold air can penetrate from the outside and exit through the exhaust openings, which is particularly unpleasant in winter. Moreover, when the kitchen appliance is not in operation, small articles, kitchen tools and kitchen waste or the like, when working on adjacent surfaces, can pass into the draught flue, so that the filter frequently requires dismantling.

The aim underlying the present invention resides in providing a construction for preventing a return flow of outside air in the case of a corresponding temperature gradient between the inner area and the atmosphere and which simultaneously prevents the penetration of foreign bodies into the draught flue when not in operation.

In accordance with advantageous feature of the present invention, at least one cover for an exhaust opening is provided on the draught flue with the covere being mounted so as to pivot between an open and a closed position and provided with a drive coupled to the fan on-off switch.

By virtue of the features of the invention it is possible to seal each draught flue in a vicinity of the exhaust opening. By coupling the drive of the cover with the fan on-off switch, it is ensured that when the exhausting means is not in use the cover is always closed. Thus, when not in use there can be a return flow of external atmosphere into the inner area, this particularly applying to cold air. It is also ensured that when the kitchen appliance or the exhaust fan is not in operation and consequently for the majority of the time articles, kitchen waste, etc. cannot drop into the draught flue. As the cover is given a planar surface, this leads to a smooth transition between the kitchen appliance and adjacent equipment or work surfaces, so that during the period of non-use, the user cannot get caught on gratings or the like with kitchen tools, pots, etc. When not in use, an esthetically satisfactory smooth surface is obtained, which can be more easily cleaned than a grating.

Advantageously, in a median longitudinal axis of the exhaust opening two covers are mounted which can be pivoted to opposite sides and which, in each case cover the entire length and half a width of the exhaust opening.

An advantage of the construction of the present invention resides in the fact that, in the case of an acceptably wide exhaust opening, the covers either do not project or only project slightly over the level of the adjacent kitchen appliance, e.g. over hotplates or the cooking surface of an electric cooker, so that work on the kitchen appliance is not impeded.

Preferably according to the present invention, the drive of the covers is so linked with the on-off switch of the fan, that, after switching off the fan, the covers close with a time lag.

The lag time can be set at random. The lower limit will be chosen in such a way that, after switching off the fan, the covers are not firmly drawn down by a vacuum which exists for a certain time period. This is also intended to ensure that even if switching on takes place immediately, the covers can be opened with limited driving force. If the fan is equipped with a servomechanism to enable it to continue running for some time after operating the manual off switch, then the covers will also only be closed at the end of this follow-up time, optionally, with the aformentioned additional lag. The fan servomechanism has the advantage that after manually operating the off switch, the user can leave the kitchen appliance or the room, although the fan continues to run for a certain time period and will only switch off at the end of the set follow-up time. In place of a delayed opening of the covers, it is also possible to have a delayed starting of the fan following the operating of the drive for the covers.

According to further advantageous feature of the present invention, the drive for the covers includes an electromagnet, which has an inexpensive construction and is also capable of applying the necessary control forces for the covers. However, it also possible to use a servomotor or the like.

According to additional advantageous features of the invention, the covers are detachably mounted on the draught flue, so that the latter can e.g. be removed for cleaning purposes and, for example can be cleaned in a dishwasher.

According to the present invention, each cover has on one end a stud and on the other end a coupling pin for the drive, whereby the latter can be inserted in a corresponding coupling sleeve on the drive and the stud can be placed in an open bearing box. The cover is inserted in simple manner in that initially the coupling pin is inserted in the coupling sleeve of the drive and is then placed with the stud in the open bearing box.

Finally, it is advantageous if the cover has, on its longitudinal side resting on the edge of the exhausting opening in the closed position, a damping material strip, e.g. an inserted O-ring. The latter avoids or greatly attenuates noise on closing the covers.

The invention is described in greater detail hereinafter relative to an embodiment and the attached drawings, wherein.

DETAILED DESCRIPTION

Figure 1:
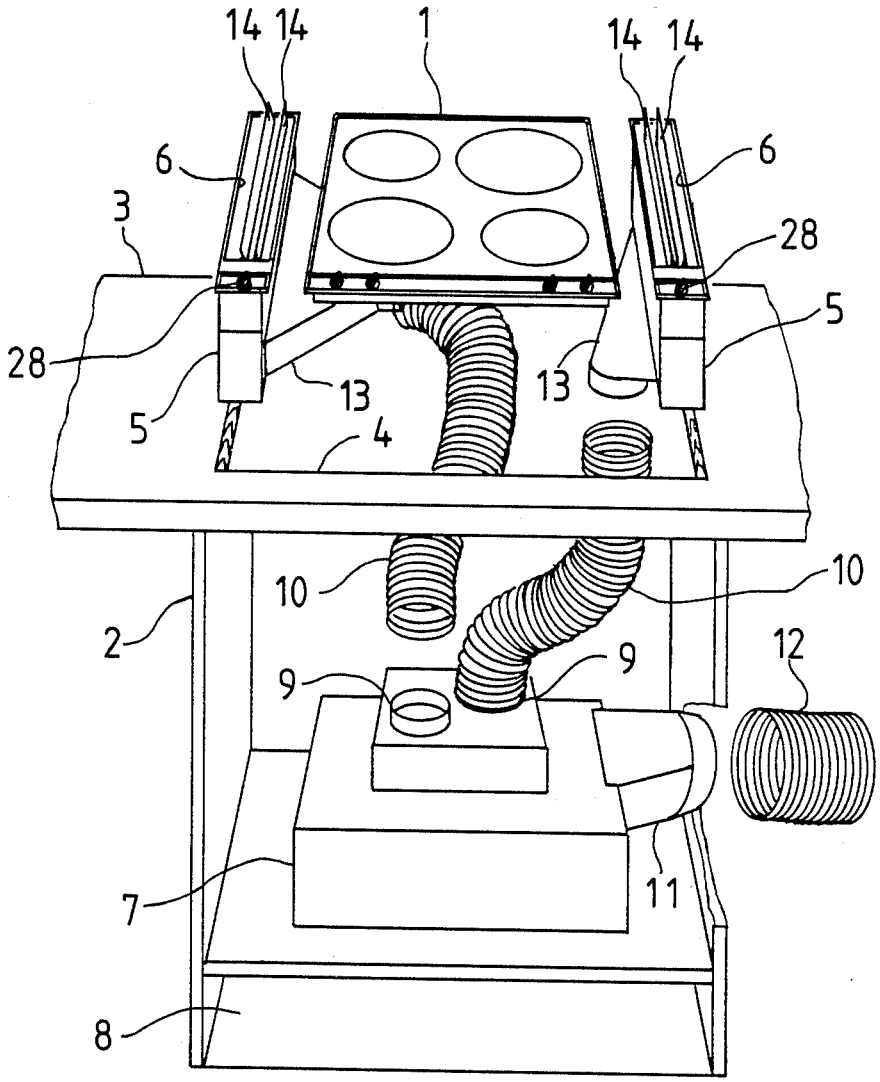
FIG. 1 is a perspective exploded view of a kitchen appliance incorporating an exhausting apparatus constructed in accordance with the present invention.

FIG. 1 is an embodiment of the apparatus in a kitchen appliance in the form of an electric hotplate or hob 1 with a cabinet suport 2, which has in its cover plate 3 an opening 4 for receiving the hob. The apparatus for removing vapor comprises two draught flues 5, which are arranged in parallel alongside the hob 1 and which, like the hob, are received by the opening 4 of the upper cover plate 3. The draught flues 5 are provided at the top with exhausting openings 6, which run in elongated rectangular manner alongside hot plate or hob 1.

The drawing-off apparatus also has a fan 7, which can e.g. be arranged in the cabinet 2, in its base 8 or outside the same at any random point. In the illustrated embodiment, fan 7 has two suction connections 9, in each case connected by a flexible line 10 at one of the draught flues 5. The pressure connection 11 of the fan is e.g. connected to the external atmosphere by means of the outgoing air duct 12.

To each draught flue 5 is fitted an exhausting connection piece 13, which can be fitted in such a way that it either extends horizontally to the side (left-hand draught flue) or vertically downwards (right-hand draught flue), so that the guidance of the air ducts 10 can be adapted to the particular space conditions.

In the represented embodiment, each draught flue 5 is provided with two juxtaposed covers 14, which are pivotably mounted in flue 5 and which can be moved from the open position of FIG. 1 to either side into the closed position. The length of the covers 14 correspond to the length of draw-off openings 6, while their width is dimensioned in such a way that two covers in each case cover the entire width of the opening 6 in the closed position.

Figure 2:
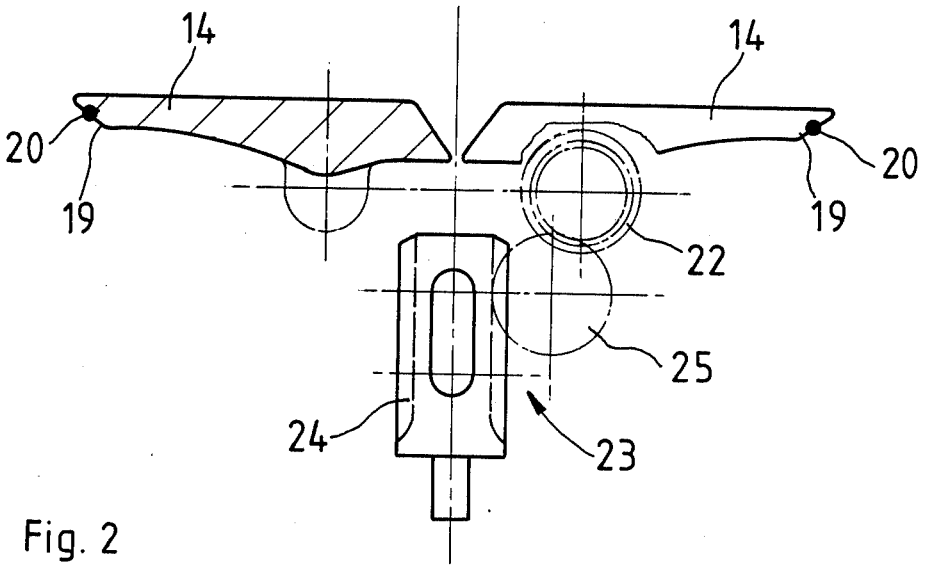
FIG. 2 is a end view of covers of the exhausting apparatus of the present invention in a vicinity of a drive thereof.
Figure 4:
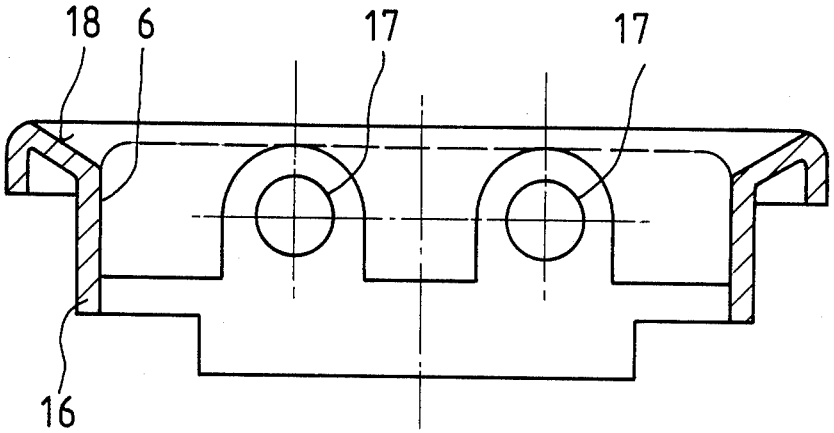
FIG. 4 is a cross-sectional view through a draught flue.

As can be gathered from FIG. 4, each draught flue 5 is provided in its upper area with a rectangular frame 16 with downwardly drawn, upper edge, by which it can be placed on the actual draught flue. Frame 16 has bearings or bearing blocks 17 for the swivel bearings of covers 14. In addition, the upper longitudinal edge of frame 16 is provided with an upwardly rising inclined plane 18. As can be seen in FIG. 2, the covers 14 are equipped on the underside of their longitudinal edge with inclined planes 19, so that in this way it is ensured that in the closed position there is a completely satisfactory engaging over and an adequate covering of the exhausting opening 6. Covers 14 can also be provided on their longitudinal inclined plane 19 with an inserted damping strip, for example, an O-ring 20.

Figure 3:
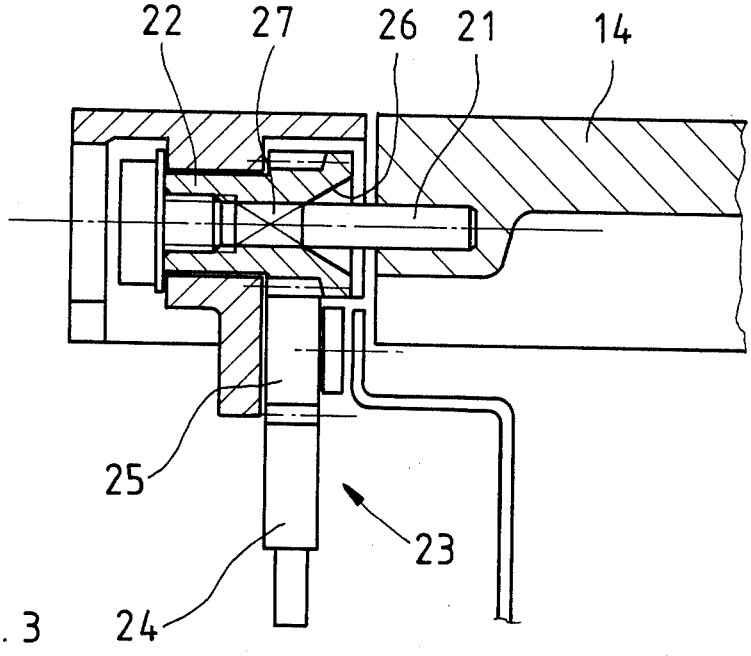
FIG. 3 is a cross-sectional view taken along the line III—III in FIG. 2 in a broken-away representation.

The covers are provided on one side (at the back of the representation of FIG. 1) with a single stud, by which it can engage in a corresponding bearing box on frame 16 (FIG. 4) and can be loosely inserted or engaged. At the other end (in the foreground in FIG. 1), covers 14 have a coupling pin 21 (FIG. 3), by means of which they can be inserted in a correspondingly shaped coupling sleeve 22, which by means of a drive 23 can be pivoted about an arc angle of approximately 90°, in order to move covers 14 between the open and closed positions.

In the represented embodiment, drive 23 comprises lifting magnet (not shown), which by means of a rack 24 acts on a pinion 25 located on either side of said rack. These pinions 25 mesh with coupling sleeve 22, so that on raising or lowering rack 25 be the lifting magnet, both covers 14 are swung synchronously, but in opposite directions into the open or closed position.

In order to facilitate the insertion of coupling pin 21, the coupling sleeve 22 is provided with a conical or pyramidal intake opening 26, while a quadrangular depression 27 is used for the actual force transfer and in it engages the coupling pin 21 with a corresponding square end. Coupling sleeve 22 is also mounted in a rotary manner in the bearing blocks 17 of frame 16 shown in FIG. 4.

Drive 23 or the lifting magnet is coupled to the on-off switch 28 (FIG. 1) for fan 7, so that on switching on the covers 14 open and then close on switching off. If desired, the closing movement can take place with a lag. The necessary electrical means are conventional and are consequently not shown.

I claim:

1. Apparatus for drawing off vapors from kitchen equipment, the apparatus comprising at least one draught flue running along one lateral side of the kitchen appliance and having a long, narrow suction opening and a fan connected thereto by flexible air ducts, characterized in that at least one cover for an exhaust opening is pivotably mounted between an open and a closed position on the draught flue and is provided with a drive coupled to an on-off switch of the fan and in that the covers are detachably mounted on the draught flue.

2. Apparatus according to claim 1, characterized in that the two covers are mounted on a median longitudinal axis of the exhaust opening, with the two covers being adapted to being swung to either side and which in each case cover a total length and half a width of the exhaust opening.

3. Apparatus according to claims 1 or 2, characterized in that the drive of covers is coupled to the on-off switch of the fan in such a way that, after switching off the fan, the drive closes the covers with a time lag or starts with a time lag after switching on fan.

4. Apparatus according to claim 3, characterized in that that the drive for the covers is an electromagnetic, servomotor, or the like.

5. Apparatus according to claim 1, characterized in that each cover is provided on one end thereof with a stud and on another end thereof with a coupling pin for the drive.

6. Apparatus according to claim 5, characterized in that the coupling pin is adapted to be inserted in a corresponding coupling sleeve on the drive and the stud is adapted to be inserted in an open bearing box.

7. Apparatus according to one of claims 1 or 2, characterized in that the covers are provided on a longitudinal side thereof resting on the edge of the exhaust opening in the closed position with a damping material strip including an inserted O-ring.

8. Apparatus according to one of the claims 1 or 2, characterized in that an upper longitudinal edge of the draught flue has an outwardly rising inclined plane and the covers are provided with a corresponding inclined plane on their longitudinal side resting on the longitudinal edge in the closed position.

9. Apparatus according to one of the claims 1 or 2, characterized in that the draught flue is constructed as a substantially rectangular box, to which can be connected a suction connecting piece simultaneously forming a transition piece to the air duct, either on left or right sides or a downward side.

* * * * *